US005775147A

United States Patent [19]

Wittwer

[11] Patent Number: 5,775,147

[45] Date of Patent: Jul. 7, 1998

[54] LOCKING DEVICE, ESPECIALLY FOR MOTOR VEHICLE LOCKING

[75] Inventor: Reinhard Wittwer, Heiligenhaus, Germany

[73] Assignee: Huelsbeck & Fuerst GmbH & Co. KG, Velbert, Germany

[21] Appl. No.: 727,400

[22] PCT Filed: Mar. 10, 1995

[86] PCT No.: PCT/EP95/00895

§ 371 Date: Dec. 18, 1996

§ 102(e) Date: Dec. 18, 1996

[87] PCT Pub. No.: WO95/28540

PCT Pub. Date: Oct. 26, 1995

[30] Foreign Application Priority Data

Apr. 13, 1994 [DE] Germany ..... 44 12 609.3

[51] Int. Cl.[6] ..... E05B 9/10

[52] U.S. Cl. ..... 70/379 R; 70/380; 70/492; 70/1.7; 70/422

[58] Field of Search ..... 70/492, 493, 372, 70/373, 375, 379 R, 379 A, 386, 416, 422, 1.5, 1.7, DIG. 36, DIG. 42, DIG. 43, DIG. 74

[56] References Cited

U.S. PATENT DOCUMENTS

| | | | |
|---|---|---|---|
| 4,854,143 | 8/1989 | Corder et al. | 70/422 |
| 5,428,978 | 7/1995 | Tsukano | 70/386 |
| 5,577,409 | 11/1996 | Oyabu et al. | 70/379 R |
| 5,640,864 | 6/1997 | Miyamoto | 70/379 R |

FOREIGN PATENT DOCUMENTS

| | | | |
|---|---|---|---|
| 014 6960 | 7/1985 | European Pat. Off. | 70/379 R |
| 444972 | 1/1991 | France . | |
| 4041134 | 6/1992 | Germany . | |
| 2005335 | 4/1979 | United Kingdom | 70/379 R |

*Primary Examiner*—Darnell M. Boucher
*Attorney, Agent, or Firm*—McAulay Fisher Nissen Goldberg & Kiel, LLP

[57] ABSTRACT

The invention is directed to a locking device with a locking cylinder which is formed of a cylinder guide and a cylinder core which is rotatably supported therein. When the key is withdrawn, the cylinder core is locked with the cylinder guide via spring-loaded tumblers. The cylinder guide is rotatably supported in the housing, but is fixed with respect to rotation therein via a catch when the key is rotated. When the key is inserted, the rotation of the cylinder core is transmitted, via a radially spring-loaded and radially displaceable radial slide, to a driver performing the locking functions in the lock. The catch has a push-rod by means of which the spring-loaded radial slide can be controlled so that the transmission of torque to the driver is interrupted when the locking cylinder is forcibly rotated. In a suggestion for a compact construction of the device with the fewest components possible, the radial slide is guided radially in the driver so that it is fixed with respect to rotation relative to the driver. Coupling faces are provided between the radial slide and the cylinder core and stop faces are provided between the radial slide and the housing. The radial slide is controlled such that it engages either with the coupling faces or with the stop faces of the housing.

10 Claims, 6 Drawing Sheets

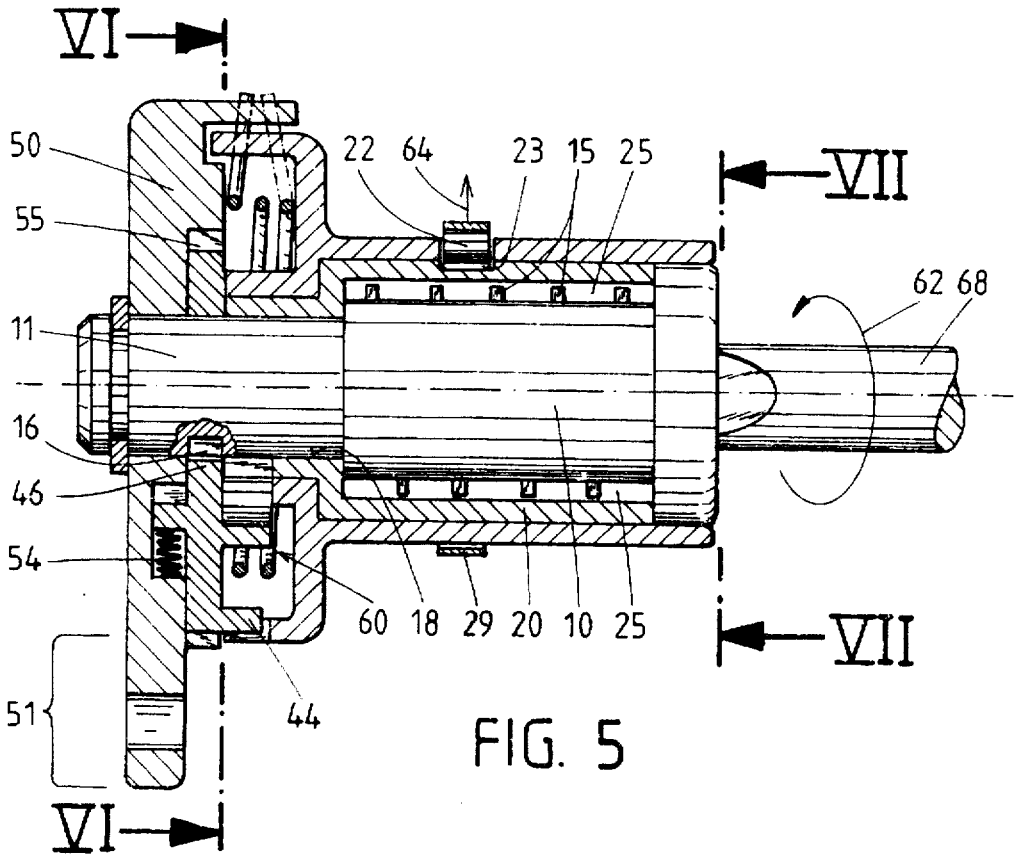
FIG. 5
FIG. 6
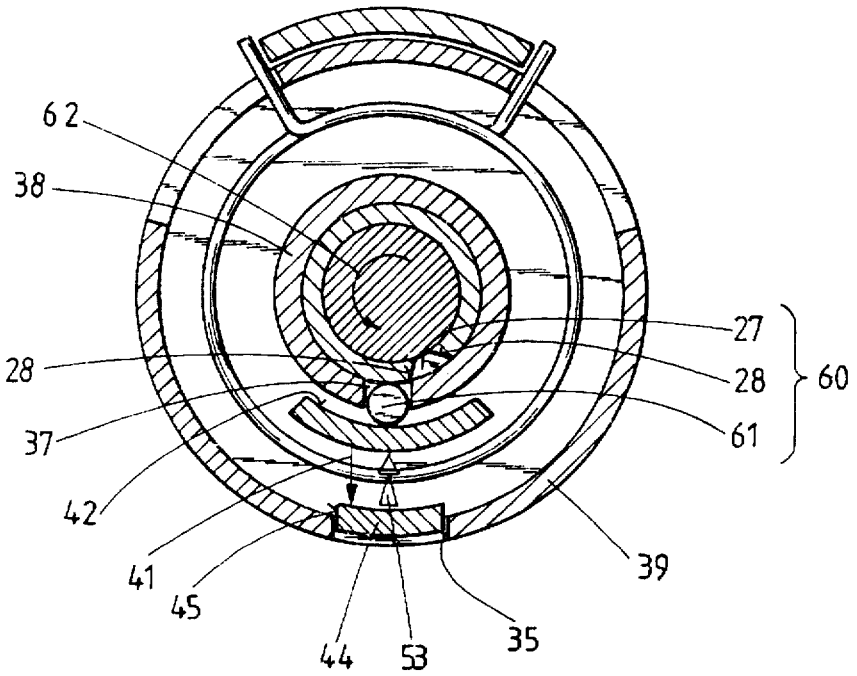

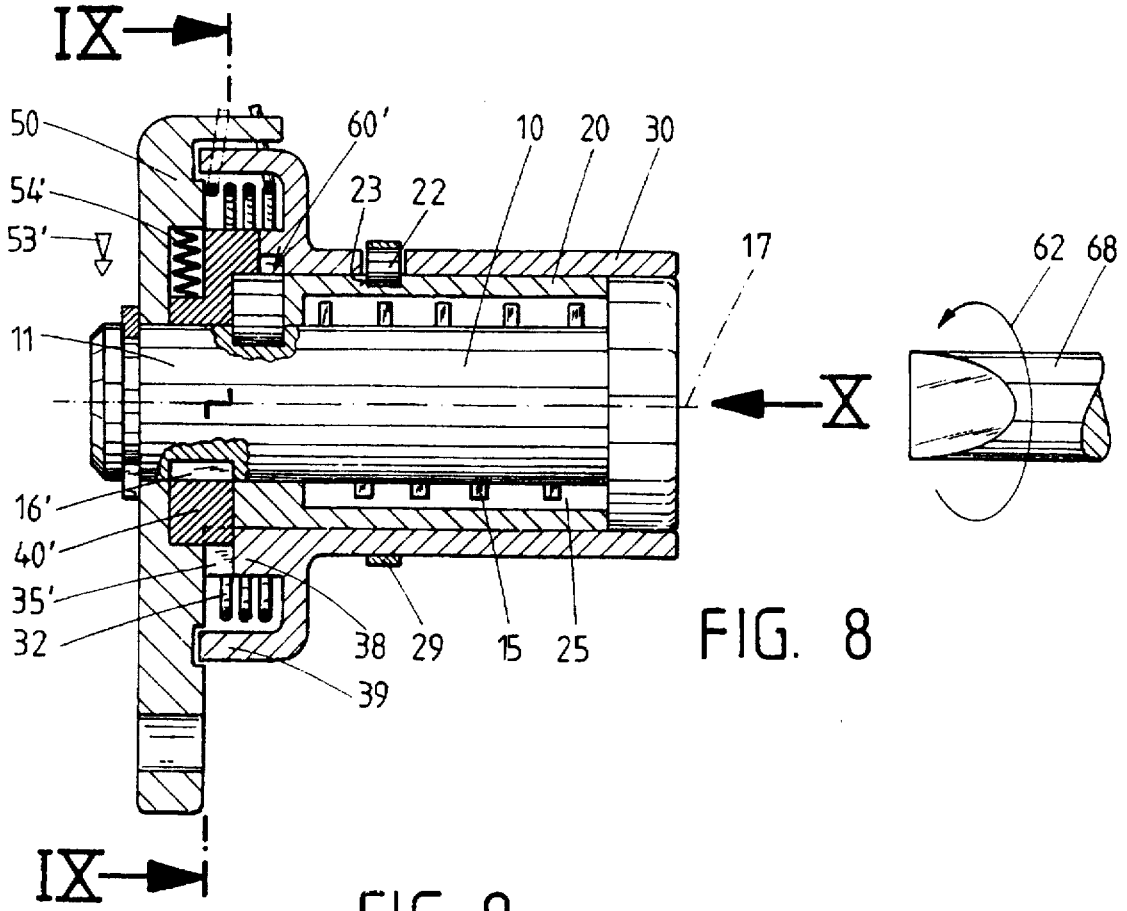
FIG. 8
FIG. 9
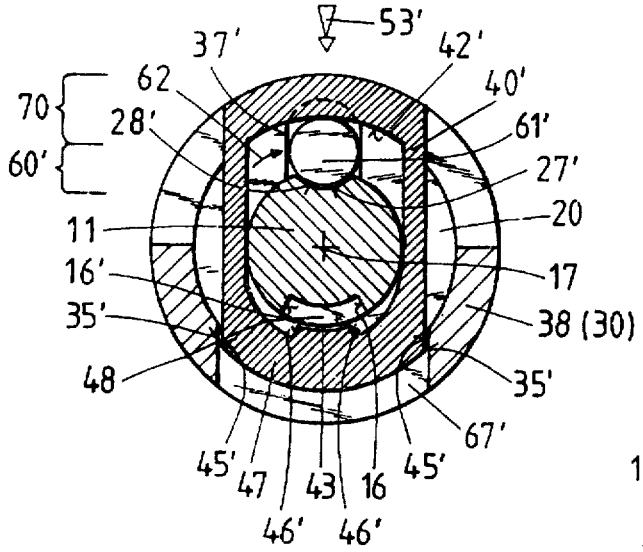
FIG. 10
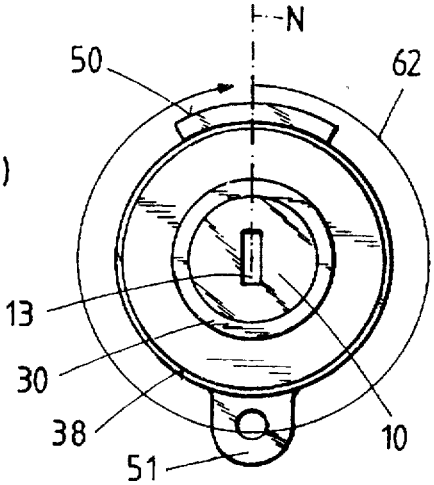

LOCKING DEVICE, ESPECIALLY FOR MOTOR VEHICLE LOCKING

BACKGROUND OF THE INVENTION

1. Field of the Invention

The invention is directed to a locking device with a locking cylinder, especially for a motor vehicle. In such device the key-operated rotation of the cylinder core is transmitted from a radial slide to a driver cooperating with lock elements, but is interrupted in the region of the driver when the locking cylinder is rotated by force because the latter is displaced by a push-rod against the force of a spring acting upon it. The push-rod is part of an overload catch having, in the adjoining structural component parts, a radial opening which encloses the push-rod and a radial recess which receives only the radial end of the push-rod. The radial recess is defined by stop cams which lift the end of the push-rod out of the radial recess during a rotation of the structural component part. Aside from controlling the radial slide, the push-rod has the function of fixing the cylinder guide in the housing when the cylinder core is rotated by means of the key, but causing the cylinder guide to run freely when the locking cylinder is rotated forcibly via a burglary tool or the like.

2. Description of the Related Art

In a known device of this type, DE-PS 40 41 134 C1, a radial slide is guided in the cylinder core so as to be displaceable. The push-rod belonging to the overload catch is pressed outward radially from the axis of the cylinder core by the spring loading of the radial slide since the radial recess for receiving the end of the push-rod is arranged at the inner surface of the housing which faces the cylinder guide. The radial slide projects axially beyond the inner end of the cylinder core and normally engages with coupling faces of the driver. When the overload catch is in its free-running position, the radial slide is displaced toward the axis of the cylinder core by the push-rod until it disengages from the coupling faces of the driver. In order to block the driver in the free-running position, an additional thrust bar is required in the driver and must be controlled by an axial pin of the radial slide. This axial control pin calls for a removal of material from the driver to allow for the radial movement of this control pin.

This known device is formed of numerous structural component parts necessitating tedious assembly and requiring considerable space. A reliable connection between the locking bar, which is displaceable in the driver, and the radial slide in the cylinder core is difficult. A relatively large clearance is required for unimpeded cooperation of the structural component parts.

In a locking device of a different type, EP 0 444 972 B1, the cylinder core which supports the spring-loaded tumblers is rotatably supported directly in the housing rather than in a cylinder guide. Therefore, there is also no push-rod which belongs to the overload catch and which is lifted out of a radial recess likewise belonging to the overload catch when a determined torque is exerted on the cylinder core and which accordingly sets the overload catch in its free-running position. Although there is a spring-loaded radial slide in this known locking device, this radial slide is positively controlled by a swivelable locking bar. The swivel axis of the locking bar is situated at the cylinder core and its head which is provided with a feeling nose engages in an axially parallel cut out portion of the cylinder core. This cut out portion extends up to the tumblers that are arranged in the cylinder core and controlled by the key. The tumblers must have additional lateral notches. The notches in the individual tumblers are so arranged that they are axially aligned with one another when the proper key is inserted into the cylinder core. The feeling nose of the locking bar can drop into the notches. A finger which extends as an axial continuation of the locking bar head drops into a radial groove of the driver (FIGS. 3, 7) or of the cylinder core (FIG. 11) and moves the radial slide into a coupling position with respect to the driver. A rotation of the cylinder core can then be transmitted to the driver via the finger of the swivelable locking bar. If the key inserted into the cylinder core is not the proper one, at least some notches of the tumblers will not be aligned with the locking bar nose and the locking bar is in a position in which it is swiveled away from the cylinder core and the locking bar finger presses the radial slide into a position in which it is uncoupled from the driver.

This known locking device has relatively numerous, complicated structural component parts which can cause problems during operation and require costly individual manufacture and assembly. Conventional cylinder cores with cylinder guides cannot be used. Rather, special shapes with integrated bearings for the locking bar and special longitudinal grooves for penetration by the feeling nose of the locking bar are required. Further, the tumblers also require a special form, namely the arrangement of additional notches which must be adapted to the control surfaces for the key. All of this renders the manufacture of such locking devices expensive. This known locking device does not offer any suggestion of how to develop a control for a locking device where an overload catch is provided in addition to the cylinder guide.

OBJECT AND SUMMARY OF THE INVENTION

The primary object of the present invention is to develop a compact locking device of the type where an overload catch is provided in addition to the cylinder guide with few structural component parts and with reliable action.

In accordance with the invention, which is designed to meet the stated object, in a locking device with a locking cylinder, especially for motor vehicle locking, the locking cylinder has a cylinder guide and a cylinder core which is rotatably supported therein so as to be fixed axially and serves to receive a key and can be locked with the cylinder guide via spring-loaded tumblers when the key is withdrawn. The cylinder guide is rotatably supported in a stationary housing, but fixed with respect to rotation therein via an overload catch which is brought into an effective position. The overload catch has a floating push-rod, a radial opening enclosing the push-rod, and a radial recess where a determined torque is exerted on the cylinder guide and accordingly sets the overload catch in a free-running position. When the inserted key is rotated, the cylinder core transmits the torque, via a radially displaceable and radially spring-loaded radial slide, to a driver which performs the locking functions in the motor vehicle. The radial slide has a stop face for the push-rod and presses the push-rod into the radial recess of the overload catch due to its spring loading. The push-rod, which is lifted out of the radial recess at a determined torque displaces the radial slide. The locking device has an improvement which comprises that the radial slide is guided radially in the driver so as to be fixed with respect to rotation relative thereto. Further, coupling faces are provided between the radial slide and one of a cylinder core and a core pin forming an extension of the core. Still further, stopping surfaces are provided between the radial slide and the housing. The improvement also comprises that the radial slide engages with either the coupling faces of the cylinder core or with the stopping surface of the housing; the radial spring loading between the driver and the radial slide presses the push-rod in the direction of the rotational axis of the cylinder core and holds the overload catch in its effective position.

In the invention, the radial slide is guided directly in the driver and cooperates directly with the coupling faces of the cylinder core or with the stopping surfaces of the housing. The control of the radial slide is effected via the push-rod of the overload catch which is pressed in the direction of the rotational axis of the cylinder core by the spring loading of the radial slide. Thus, the overload catch is always in the effective position, where the cylinder guide enclosing the cylinder core is fixed with respect to rotation in the housing. The invention allows for a compact, space-saving construction working in a trouble-free manner.

In the invention, the cylinder guide is a component part of the overload catch and has either the radial recesses for the end of the push-rod or the radial opening for the floating push-rod. In the former case, the overload catch is constructed in the manner of a clutch release system which is indicated more fully in claim 2 and is shown in the embodiment example in FIGS. 1 to 7. Other details are indicated in claim 3. In the latter case, the overload catch is constructed in the manner of a clutch engaging system as is explained more fully with reference to FIGS. 8 to 13.

Further steps and advantages of the invention are indicated in the rest of the claims, the following description, and the drawings. The invention is shown in two embodiment examples in the drawings.

BRIEF DESCRIPTION OF THE DRAWINGS

FIG. 5 shows a longitudinal section through this device corresponding to FIG. 1 when an overload protection has been brought into the free-running position due to a forcible rotation of a burglary tool;

FIG. 6 shows a cross section corresponding to FIG. 2 through the device in the free-running position shown in FIG. 5;

FIG. 8 shows an axial section through a second locking device according to the invention which is also shown only schematically, wherein the cylinder core is in the neutral position prior to the insertion of the key;

FIG. 9 shows another schematic cross section through the device along the offset section line IX—IX of FIG. 8;

FIG. 10 shows the front view of the device from FIG. 8 as seen in the direction of arrow X in FIG. 8;

DESCRIPTION OF THE PREFERRED EMBODIMENTS

Figure 1:
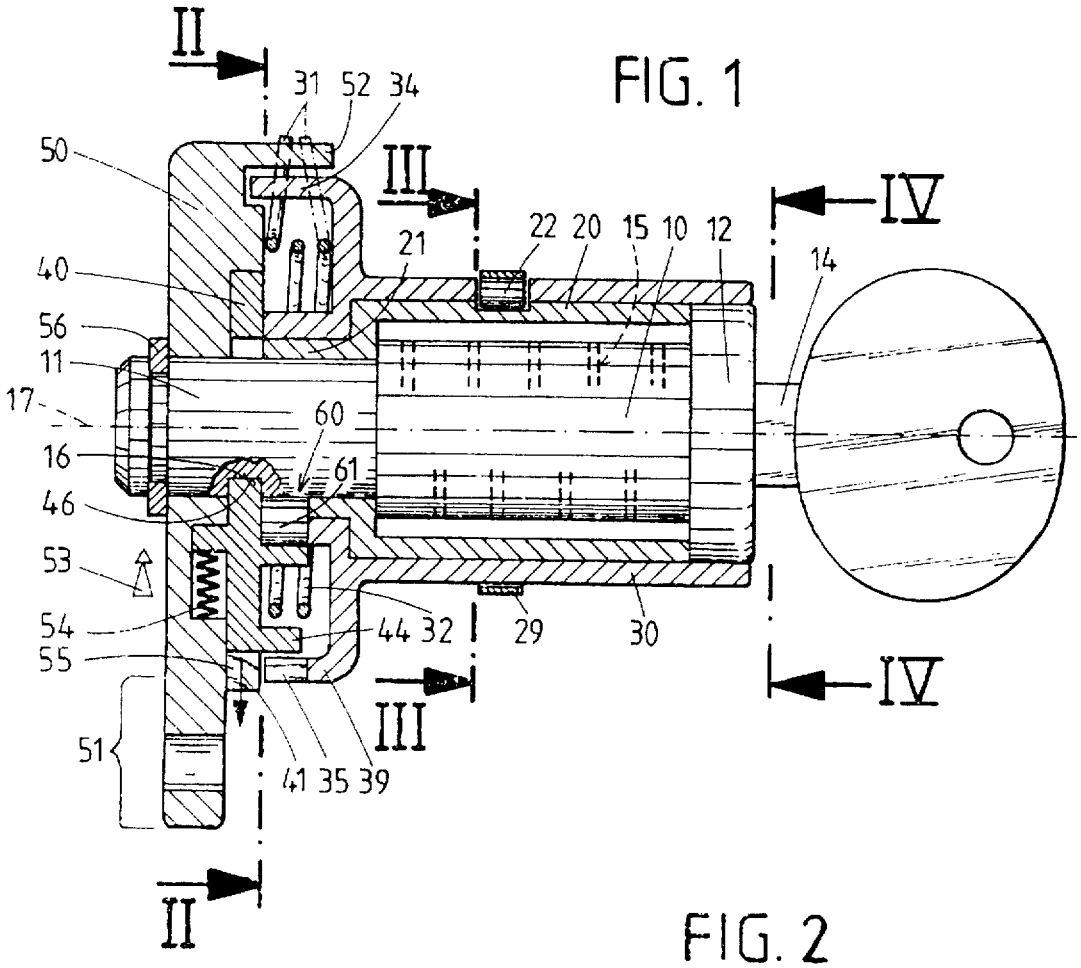
FIG. 1 shows a schematic longitudinal section through a first embodiment form of the locking device, according to the invention, when the key is inserted and the cylinder core is in its neutral position in which the key can be inserted and withdrawn.

The first embodiment form of the locking device, according to the invention, which is shown in FIGS. 1 to 7 is preferably installed in motor vehicles and comprises a locking cylinder which is formed of a cylinder guide 20 and a cylinder core 10 which is rotatably supported therein so as to be fixed axially. This axially fixed connection is represented by inner stepped surfaces between a guide bush 21 forming an axial prolongation of the cylinder guide 20 and a core pin 11 forming an axial lengthening of the cylinder core 10. Also associated therewith is a widened head 12 at the cylinder core which is supported at the front end of the cylinder guide 20. The cylinder core 10 has a key groove 13 shown in FIGS. 3 and 4 for receiving a key 14 shown in FIG. 1 and a family of spring-loaded tumblers 15 which can be seen most clearly from FIG. 3 because the key 14 has been removed in this figure. When the key 14 is not inserted in the cylinder core 10, the tumblers 15 are pressed outward radially because of the spring loading and engage in a catch groove 25 as will be seen from FIG. 5. In the embodiment example shown in the drawing, two catch grooves 25 are located opposite one another. The tumblers 15 which exit from the cylinder core 10 diametrically opposite one another move into the catch grooves 25 and lock the cylinder core 10 in the cylinder guide 20.

Figure 2:
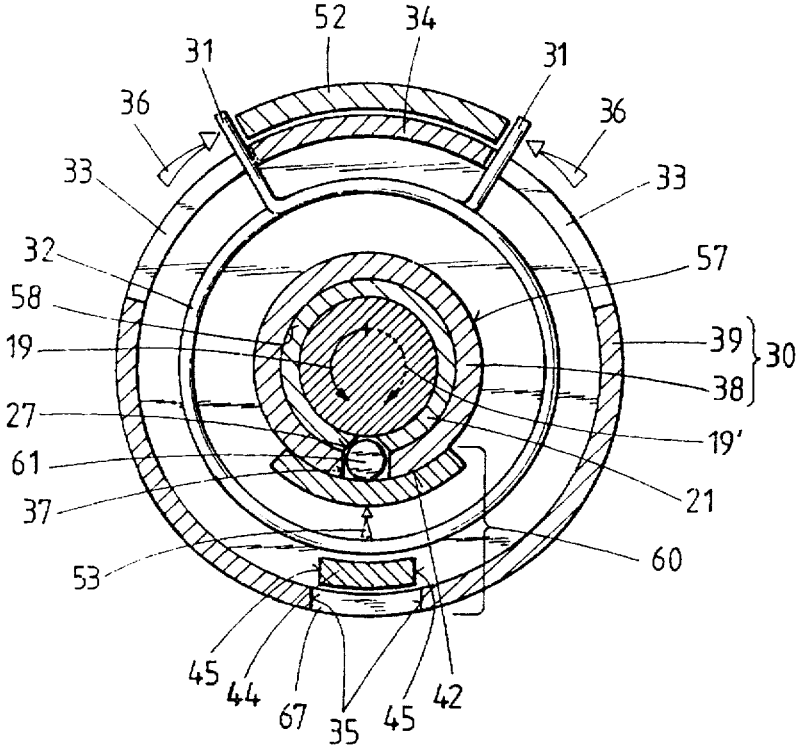
FIGS. 2 and 3 show a cross-sectional view through the device along section line II—II and III—III of FIG. 1, wherein the key has not yet been inserted in FIG. 3.

The cylinder guide 20 is rotatably supported per se in a stationary housing 30, but, according to FIG. 2, is normally fixed with respect to rotation in the housing 30 via an overload catch 60 which will be described more fully hereinafter. The cylinder guide 20 is positioned in the housing 30 so as to be fixed axially so that the cylinder core 10 is also fixed axially in the housing 30 via the axially fixed connection mentioned above. A driver 50 is rotatably supported on its core pin 11 and is arranged at a defined distance from the housing 30 via a snap ring 56. The driver 50 has an arm 51 which can execute the desired locking functions in the motor vehicle via additional lock elements, not shown.

The driver 50 is held in a defined initial rotational position by means of an impulse spring 32 which is represented in FIG. 1 by the arm 51 shown by a solid line. This impulse spring 32 has two substantially radially extending spring legs 31 which penetrate two openings 33 in the housing 30 and enclose between them on either side a finger 52 which is provided at the driver 50. Between the two openings 33 there is formed a housing web 34 at which the driver finger 52 is held by the spring legs 31 in a springing manner in the direction of the two arrows 36 representing the spring force. This initial rotational position of the driver 50 also affects the cylinder core 10 for reasons to be explained hereinafter.

A radial slide 40 is guided at the driver 50 in the displacement direction indicated by arrow 41 shown in FIG. 1 and is therefore always connected with the driver 50 so as to be fixed with respect to rotation relative thereto. This guide 55 in the driver 50 is shown in FIG. 5. A radial spring loading in the force direction indicated by arrow 53 shown in FIG. 1 acts on the radial slide 40. This is effected by a pressure spring 54 in a recess supported at both ends at radial stepped surfaces between the driver 50 and the radial slide 40. The slide 40 is accordingly pressed in the direction of the cylinder is longitudinal axis 17 shown in dash-dot lines in FIG. 1 and, as is shown in FIG. 1, brings about the engagement of the coupling faces 16, 46 which can be seen most clearly in FIG. 5. In the present case, these coupling faces are formed of a radial projection 46 at the radial slide 40 and a radial depression 16 in the circumferential surface 18 of the core pin 11. The initial rotational position of the driver 50 described above is accordingly transmitted to the cylinder core 10 via the slide 40 and the engaged coupling 16, 46. The cylinder core 10 is therefore also held by means of the impulse spring 32 with reference to the key groove 13 of FIG. 4 in the "neutral position" represented by the auxiliary line N.

Figure 4:
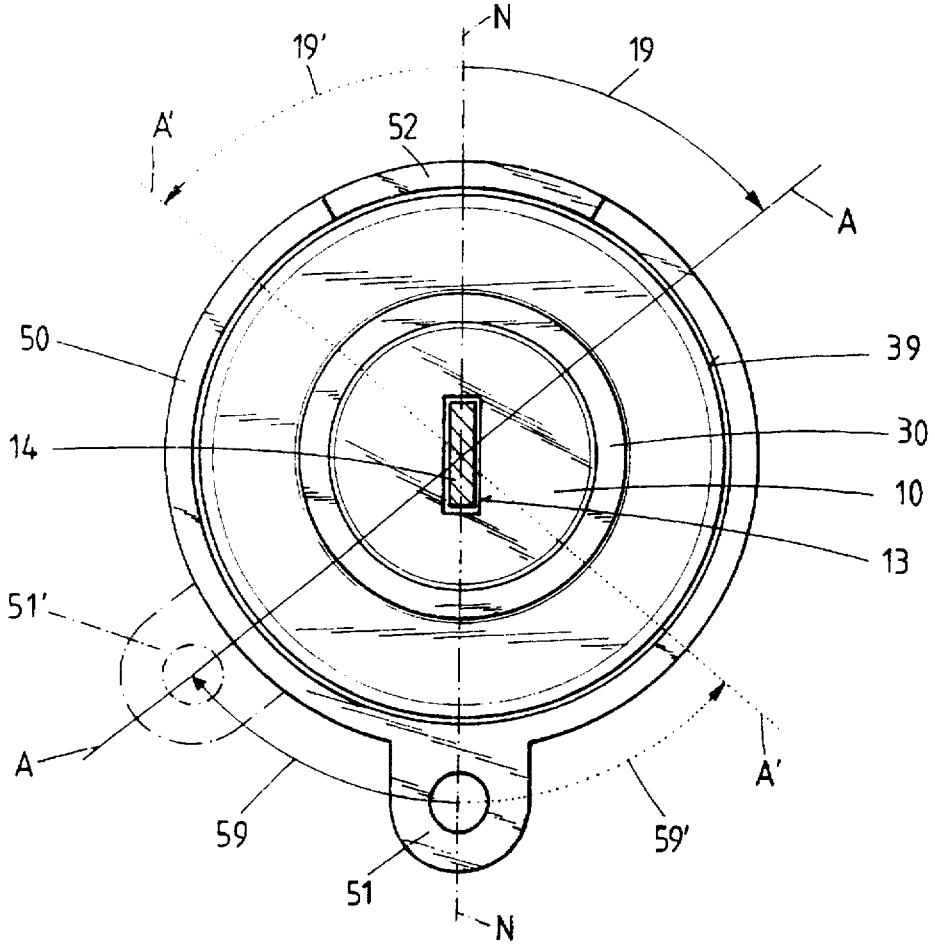
FIG. 4 shows a front view of the device shown in FIG. 1 with a section through the key shank along section line IV–IV of FIG. 1.

In this neutral position N shown in FIG. 4, the proper key 14 can be inserted into or withdrawn from the cylinder core 10. In the inserted state of the key 14, the tumblers 15 are aligned on the circumference of the cylinder core 10 as is shown in dashed lines in FIG. 1. The cylinder core 10 is then rotatable in the cylinder guide 20. When the key 14 is actuated in the rotational direction indicated by the arrow 19 shown in FIG. 4 into one or more of the working positions which are angularly offset relative to one another, one of which is represented by auxiliary line A in FIG. 4, the driver 50 is also rotated along via the coupled radial slide 40, which is shown in FIG. 4 by a corresponding rotation arrow 59. The driver arm 51 which is first located in the corresponding neutral position N according to FIG. 4 is accordingly swiveled into the corresponding working position 51' shown in dash-dot lines in FIG. 4 in which the connected lock elements, which were already mentioned above, execute the desired locking functions in the motor vehicle. When the key 14 is released, the driver 50 and accordingly also the cylinder core 10 move again into the neutral position N shown in FIGS. 2 and 4 by means of the impulse spring 32.

Instead of the cylinder rotation 19 according to FIG. 4, the cylinder core 10 could also be rotated in the opposite direction as indicated by the dotted arrow 19' via the key 14 in order to move it into an alternative working position A' which is likewise shown in dashed lines in FIG. 4. Naturally, during this opposite rotation 19' the driver also executes the opposite rotation of its arm 51 as is shown by the corresponding dotted arrow 59' in FIG. 4. The arm 51 is indicated by the corresponding dotted auxiliary line A'.

The overload catch 60, mentioned above, serving to fix the cylinder guide 20 with respect to rotation in the housing 30 has the special construction which is shown in FIGS. 1 and 2. This construction is made up in part by a floating push-rod 61 which is constructed in the present instance as a roller 61. This roller 61 is enclosed by a radial opening 37 which, in this embodiment example, is located in an inner sleeve 38 belonging to the housing 30. The described impulse spring 32 is coiled around this inner sleeve 38 of the housing. The overload catch 60 also comprises a radial recess 27 in which the roller 61 normally engages by its inner radial end. This occurs as a result of the described spring loading 53 of the pressure spring 54 by means of a stop face 42 which is provided at the radial slide 40. As will be seen from FIG. 2, this stop face 42 extends in the rotating direction 19 and 19' of the key-actuated rotation shown in FIG. 4. That is, the spring-loaded stop face 42 is located at the cylindrical outer surface 57 of the inner sleeve 38 of the housing, while the radial recess 27 of the cylinder guide 20 of the opposite inner surface 38 faces this inner sleeve 38 of the housing. The radial recess 27 is worked into the circumferential surface of the guide bush 21, already mentioned above, which forms an axial extension of the cylinder guide.

Figure 3:
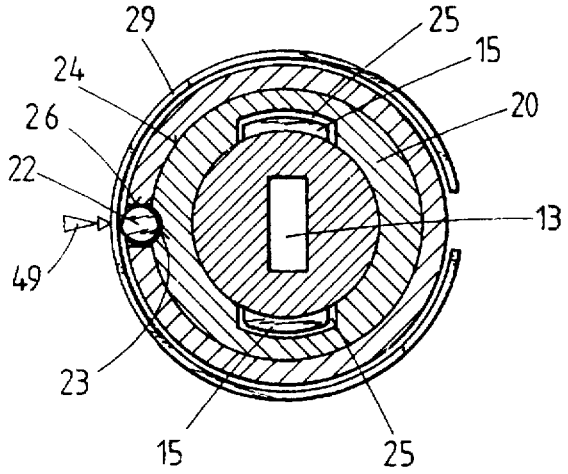

If required, the cylinder guide 20 can also be fixed with respect to rotation in the housing 30 by means of an additional catch holder 22, 23. As is shown in FIGS. 1 and 3, this is formed of a catch projection 22 which, in this instance, is simply a movable roll. The complementary element of the catch holder is formed of a catch depression 23 which is incorporated in the outer surface 24 of the cylinder guide 20. The roll 22 is located in a wall bore hole 26 of the housing 30 and is pressed inward in the direction of force indicated by the arrow 49 shown in FIG. 3 by a leaf spring 29 located at the housing circumference. Thus, the roll 22 normally engages with the catch depression 23 and fixes a defined rotational position of the cylinder guide 20 in the housing 30. However, the rotational position is also fixed by means of the overload catch 60 mentioned above. This only changes when violent force is applied according to FIGS. 5 to 7.

Figure 7:
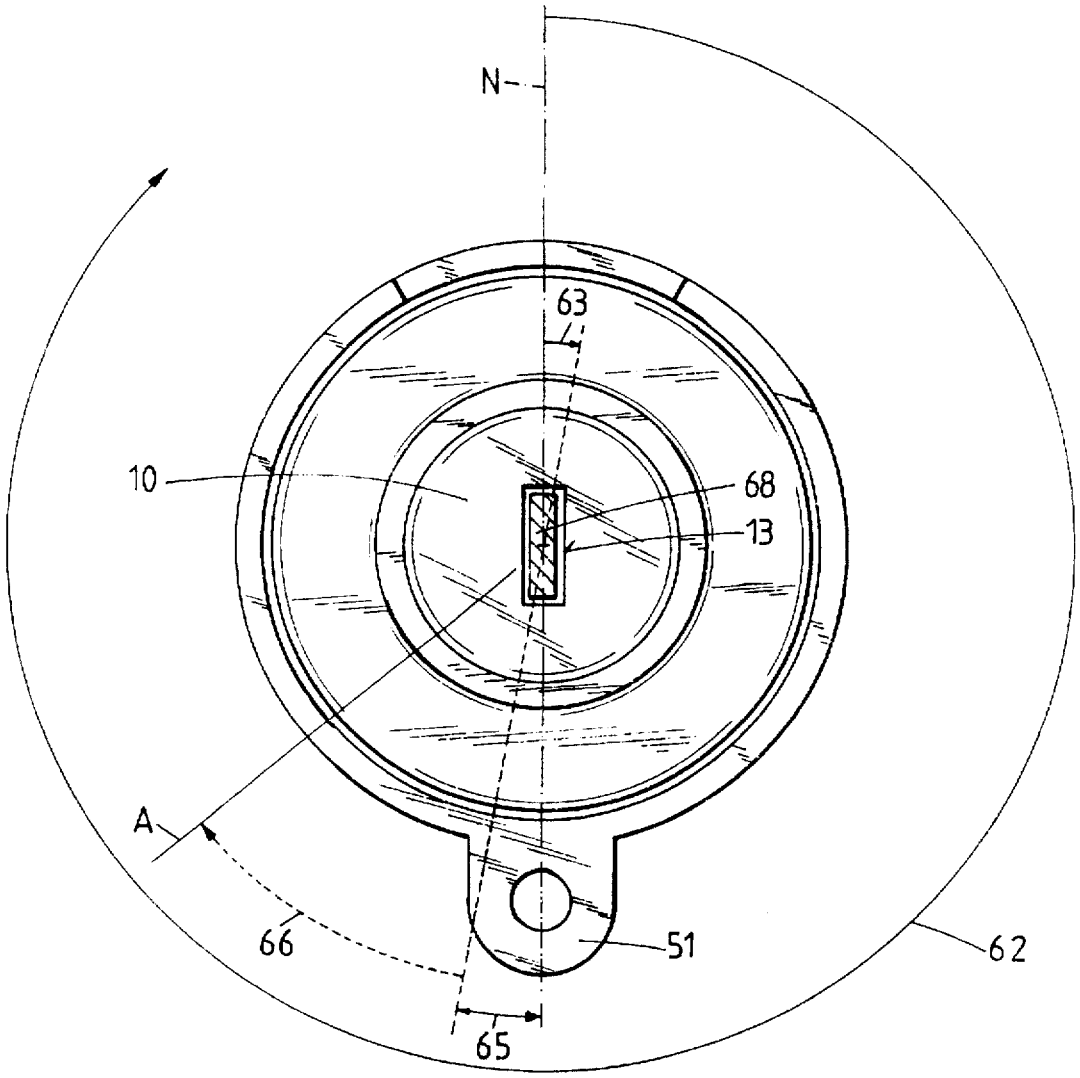
FIG. 7 shows a front view of the device corresponding to FIG. 4 with a section through the burglary tool along section line VII—VII from FIG. 5.

FIG. 5 illustrates the attempt on the part of an unauthorized person not in possession of the proper key 14 to break open the locking device according to the invention. For this purpose, a burglary tool 62, e.g., the tip of a screwdriver according to FIG. 7, is inserted into the key groove 13 of the cylinder core 10 and forcible rotation 62 illustrated in FIG. 5 is applied to the cylinder core 10. In this case, however, as was already mentioned, the tumblers 15 are in the locking position with the cylinder guide 20, so that the entire locking cylinder 10, 20 is subjected to the forcible rotation 62. In FIGS. 5 and 6, a small initial rotation shown in FIG. 7 is to be effected in the rotating direction shown by the arrow 63 in FIG. 7. This results in the situation shown in FIG. 6. The radial recess 27 in the guide bush 21 of the cylinder guide 20 is defined in the direction of the forcible rotation 62 by stop cams 28 which face toward the above-mentioned inner surface 58 of the inner sleeve 38 of the housing. The roller 61 consequently runs against the corresponding stop cam 28 and is accordingly lifted out of the radial opening 27. In so doing, the roller 61 moves in the vertical plane of the housing 30 determined by the radial opening 37 and presses against the stop face 42 of the radial slide 40. The radial slide 40 is accordingly set radially outward in the displacement direction indicated by the arrow 61 shown in FIG. 6 against the spring loading 53 of the pressure spring 54. The guide bush 21 of the cylinder guide 20 is now free so that the above-mentioned forcible rotation 62 of the entire locking cylinder 10, 20 can take place. The overload catch 60 is in the free-running state.

The limiting torque which sets the overload catch 60 in the free-running state is determined on the one hand by the given pretensioning of the pressure spring 54 and on the other hand by the inclination of the stop cams 28 of the locking radial recess 27. Naturally, the catch holder 22, 23 described with reference to FIG. 3 is also released in the free-running situation. As will be seen from FIG. 5, the roll 22 is pressed outward radially out of the catch depression 23 into the cylinder guide 20 against the tension of the leaf spring 29 in the movement direction indicated by the arrow 64. Apart from the slight initial rotation 63 which is required for moving the roller 61 into the free-running position of the overload catch 60 shown in FIG. 6, the continuing forcible rotation 62 of the cylinder guide 10, 20 is no longer transmitted to the driver 50 as in FIGS. 1 to 4 for reasons explained hereinafter.

During the displacement 41 of the radial slide 40 in the guide 55 of the driver 50 according to FIG. 6, the cooperating coupling faces 16, 46 are moved into their uncoupled position shown in FIG. 5. The forcible rotation 62, which also has an effect in the core pin 11, can accordingly no longer be transmitted to the driver 50. The driver arm 51 according to FIG. 7 remains stationary during the rotational movement 62 apart from a slight oscillation 65 when the roller 61 is lifted out during the initial rotation 63. The locking functions in the lock are so dimensioned that these oscillations 65 of the driver arm 51 have no effect. At all events, it is important that the rotation of the driver arm which is decisive for an adjusting movement of the lock elements in the motor vehicle and is illustrated by the dashed arrow 66 in FIG. 7 does not enter the working position represented by the auxiliary line A.

Further, during the free-running of the overload catch 60 the driver 50 is in a locking position which is also caused by the radial slide 40. In addition, as is shown most clearly in FIGS. 1 and 2, the radial slide 40 has a locking tongue 44 with stopping surfaces 45 on both sides. The housing 30, specifically its outer sleeve 39, has the respective counter-stopping surfaces 35 which are formed by a corresponding housing recess 67. When the overload catch 60 is active, as is shown in FIGS. 1 and 2, the stopping surfaces 35, 45 are in a release position. However, when the overload catch 60 is in the free-running position according to FIGS. 5 and 6, the locking tongue 44 moves into the housing recess 67. The stopping surfaces 35, 45 on both sides are then in their locking position. The radial slide 40 is then blocked in the housing 30. It is not possible to manipulate the driver arm 51 in order to carry out the critical arm rotation 66 described above with reference to FIG. 7. A forcible break-in has no effect on the locking device according to the invention.

An alternative device according to the invention is shown in the embodiment example in FIGS. 8 to 13. To the extent that the preceding description also applies in part to this alternative device, the same reference numbers will be used. The discussion will be restricted to the differences between the embodiment examples, principally in the region of the corresponding radial slide 40' and the overload catch 60'. In order to show the differences in operation more clearly, a stroke (') is added to the reference numbers to distinguish them from those used in the first embodiment example according to FIGS. 1 to 7.

The first embodiment example of FIGS. 1 to 7 is directed to an overload catch 60 which fixes the cylinder guide 20 in the housing 30 in the neutral position N according to FIGS. 1 to 4. As was already described, this remains so during the key rotation 19 and 19' according to FIGS. 2 and 4. As was already described, the free-running of the cylinder guide 20 first resulted from the forcible rotation 62 of the cylinder guide 20 according to FIGS. 5 and 6. Very different and, in tart, opposite conditions apply in this respect to the overload catch 60' of the second embodiment example shown in FIGS. 9 to 13. In the neutral position of the cylinder core 10 shown by the auxiliary line N in FIG. 10, the cylinder guide 20 is already in a free-running position in the housing 30 regardless of whether or not a key is inserted. However, the cylinder guide 20 is first locked in its neutral position N, specifically, apart from the catch holder 22, 23 which is also provided in this second embodiment example and was already described above with reference to FIG. 3, primarily by means of the overload catch 60' which in this case is constructed in the manner described hereinafter.

Figure 11:
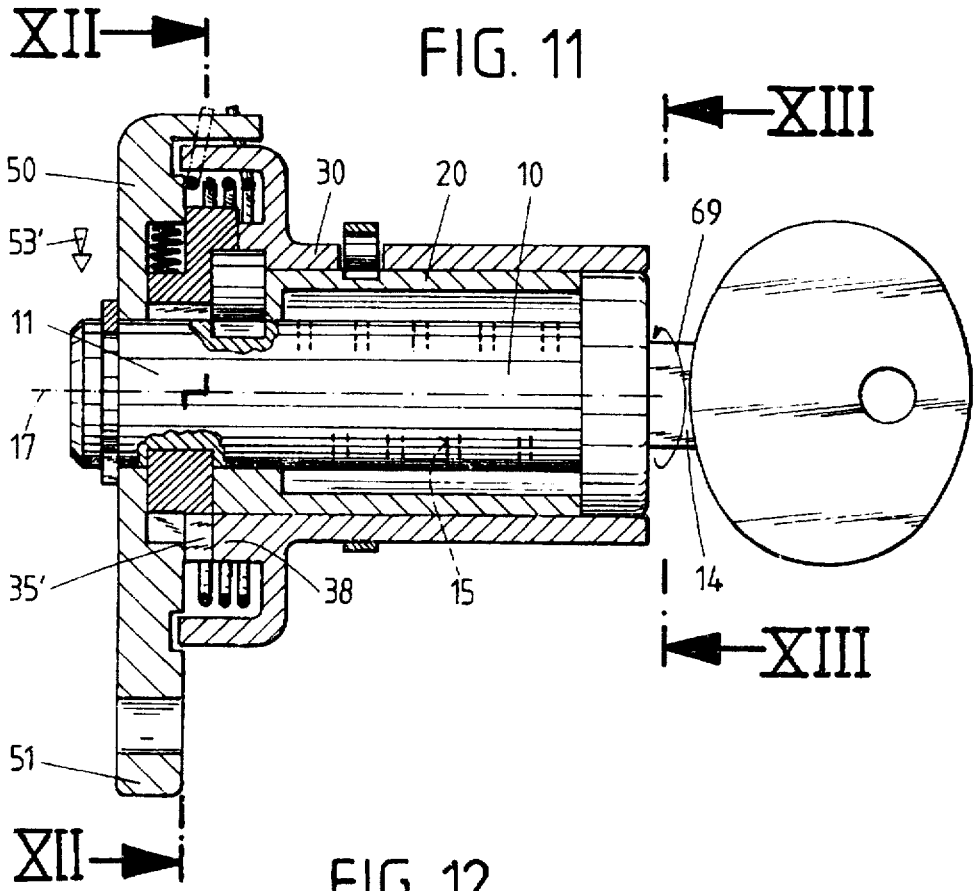
FIG. 11 shows an axial section corresponding to FIG. 8 through this device, but after the key has been inserted and turned somewhat.
Figure 12:
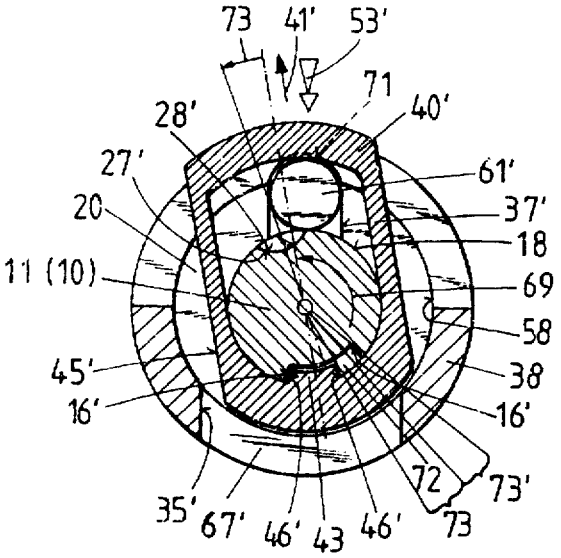
FIG. 12 shows the conditions along section line XII—XII of FIG. 11 resulting after the rotation of the key as shown in FIG. 11 in a sectional view corresponding to FIG. 9.
Figure 13:
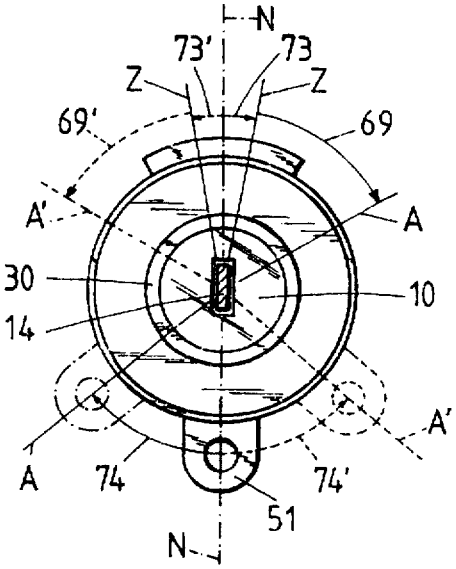
FIG. 13 shows the front view of the device from FIG. 11 in section through the key along section line XIII—XIII corresponding to FIG. 10.

The corresponding roller 61' of this overload catch 60' which functions as a floating push-rod is located, according to FIG. 9, in a radial opening 37' which penetrates the wall of the cylinder guide 20. The radial recess 27', on the other hand, is located in a core pin 11 which also forms an axial continuation of the cylinder core 10 in the present case. However, the inner radial end of the roller 61' now engages in this radial recess 27'. The stop cams 28' on both sides can be constructed so as to be relatively flat in this case since the fixing of the cylinder guide 20 with respect to rotation which is critical for the key actuation according to FIGS. 11 to 13 is brought about via a locking catch 70 which is combined with the overload catch 60' and which will be described more fully in the following. The slide 40' also has a stop face 42' for the roller 61' which is pressed by a similar pressure spring 54' likewise in the direction of the cylinder axis 17 according to FIG. 8, but the spring loading 53' brought about thereby acts on the radial slide 40' in the opposite direction compared with the first embodiment example. The spring loading 53' according to FIG. 8 normally tends to hold the radial slide 40 in an uncoupled position according to FIG. 9.

According to FIG. 9, the critical coupling faces 46' are located at a radial projection 43 which is located at a web 47 on the side of the radial slide 40' opposite the cylinder axis 17 with reference to the effective stop face 42' for the roller 61'. However, the corresponding counter-coupling faces 16' are also located in this case at the core pin 11, namely in a radial depression 48 which is widened angularly relative to the projection 43. The coupling faces 46' are produced by the flanks of the projection 43. In the neutral position, the projection 43 is held so as to be pressed out of the radial depression 48 in the core pin 11 owing to the spring loading 53' acting on the radial slide 40' according to FIG. 9.

This uncoupled position of 46', 16' is also maintained during a forcible rotation 62 of a burglary tool, e.g., a screwdriver, which is indicated in FIG. 8 but is not yet shown in the inserted position. As is shown in FIG. 10 and also in FIG. 9 by the corresponding rotation arrow 62, the entire locking cylinder 10, 20 can be rotated in the housing 38, wherein, in contrast to the preceding embodiment example, the roller 61' participates in the rotation. This is a result of the radial opening 37' which is now provided in the cylinder guide 20 and which carries the roller 61' along with it. The cylinder core 10 and the cylinder guide 20, that is, the entire locking cylinder, are rotated in the direction indicated by the arrow 62 via the locked tumblers 15. In spite of this function of the radial slide 40' with respect to the coupling 16', 46', which is the opposite of that in the first embodiment example, an analogous locking position of the driver 50 results.

Also, in the second embodiment example the housing 30 is divided into an inner sleeve 38 and an outer sleeve 39 in the region of the driver 50. The stopping surfaces 45' which are of decisive importance for locking are located at the lateral boundary of the aforementioned web 47 of the slide 40'. Although the associated counter-stopping surfaces 35' are also arranged in a housing recess 67' as will be seen from FIG. 9, this housing recess 67' is located in the region of the inner sleeve 38 in contrast to the preceding embodiment example. This locking position between the stopping surfaces 35', 45' at either side is also in effect during the forcible rotation 62 of the locking cylinder 10, 20 described above. The radial slide 40' is held stationary with respect to the housing 30 and prevents a rotation of the driver 50 and accordingly a movement of its arm 51. This situation remains in effect at first when the proper key is inserted into the key groove 13 shown in FIG. 10 in the neutral position N shown in FIGS. 8 to 10.

The situation changes, however, according to FIGS. 11 to 13, when the inserted key 14 finally reaches the rotation region 69 or 69' of FIGS. 12 and 13. As was already described, the tumblers, as will be seen from FIG. 11, are first aligned on the diameter of the cylinder core 10 when the key 14 is inserted so that the cylinder core 10 can be rotated with respect to the cylinder guide 20 proceeding from the neutral position shown in FIG. 9. The cylinder guide 20 is first locked by means of the aforementioned catch holder 22, 23. During the first movement phase, namely during the initial rotation 73 and 73' shown in FIGS. 12 and 13, the roller 61' which rests in the radial opening 37' of the cylinder guide 20 moves out of the radial recess 27' via its stop cam 28' and comes to rest at the circumferential surface 18 of the cylinder core 10. The cylinder core 10 is then in an intermediate position, designated in FIG. 13 by Z, a displacement 41' of the radial side 40' opposite the radial spring loading 53' taking place up to this intermediate position Z. This has a fourfold result.

Since the roller 61' has moved out of the radial recess 27', the overload catch 60' mentioned in FIG. 9 is released. However, the locking catch 70 mentioned with reference to FIG. 9 is then activated. This locking catch 70 comprises the roller 61' in the radial opening 37' of the cylinder guide 20. However, an additional catch recess 71 is located at the inner cylinder surface 58 of the inner sleeve 38. The outer radial end of the roller 61' now moves into this additional catch recess 71 according to FIG. 12 and accordingly fixes the cylinder guide 20 in the inner sleeve 38 of the housing. The roller 61' is now held immovably between the cylinder core circumferential surface 18 on the one side and the catch recess 71 on the other side. In this second embodiment example, the spring loading 53' plays no part in fixing the cylinder guide 20. The other decisive key rotation 69 or 69' according to FIG. 13, in which the cylinder core 10 is moved out of an intermediate position Z determining the reversing movement into its working position A, can now be carried out.

Another result of the displacement 41' effected in FIG. 12 consists in that the stopping of the radial slide 40' in the inner bush 38 of the housing is now effected in its release position. The radial slide 40' moves entirely out of the housing recess 67' so that the cooperating stopping surfaces 35', 45' are disengaged. Finally, the displacement 41' brings about the engagement of the coupling 16', 46' described above with reference to FIG. 9. According to FIG. 12, this takes place because the coupling projection 43 of the slide 40' moves into the radial depression 48 of the cylinder core 10. After the initial rotation 73 or 73', one coupling surface 16' provided at the core pin 11 comes into contact with one flank 46' of the projection 43, while a free gap 72 remains between the two other stopping surfaces 16', 46' according to FIG. 12. Since in the present instance the key rotations can be carried out in a mirror-inverted manner relative to one another as is illustrated in FIG. 13, the free gap 72 is constructed according to FIG. 12 so as to be greater than or equal to twice the angular region of 73, 73' given in both directions for the initial rotation which determines the lifting out of the roller 61'.

Since the coupling faces 16', 46' are effective only after the initial rotation 73 or 73', the subsequent further key rotation 69 or 69' can be transmitted to the driver 50. Consequently, during the lifting out of the roller 61', that is, during the initial rotation 73 and 73', the driver arm 51 at first remains stationary in its normal position N which is shown in solid lines in FIG. 13. Only then, during the further rotation 69 and 69' of the key, is the driver arm 51 moved into its working position, shown in dash-dot lines or dashed lines, as shown by the swivel arrows 74, 74', characterizing its working position A.

While the foregoing description and drawings represent the preferred embodiments of the present invention, it will be obvious to those skilled in the art that various changes and modifications may be made therein without departing from the true spirit and scope of the present invention.

What is claimed is:

1. The locking device with a locking cylinder, especially for motor vehicle locking, wherein the locking cylinder has a cylinder guide and a cylinder core which is rotatably supported therein along a longitudinal axis so as to be fixed axially and serves to receive a key and can be locked with the cylinder guide via spring-loaded tumblers when the key is withdrawn, the cylinder guide being rotatably supported in a stationary housing, but fixed with respect to rotation therein via an overload catch which is brought into an effective position, wherein the overload catch has a floating push-rod, a radial opening enclosing said push-rod, and a radial recess which receives only an inner radial end of the push-rod the radial recess being defined by stop cams which lift the end of the push-rod out of the radial recess when a determined torque is exerted on the cylinder core or by the cylinder core on the cylinder guide and accordingly set the overload catch in a free-running position, and when the inserted key is rotated, the cylinder core transmits the torque, via a radially displaceable and radially spring-loaded radial slide, to a driver which performs the locking functions in a motor vehicle wherein the radial slide has a stop face for the push-rod and presses the push-rod into the radial recess of the overload catch due to the spring-loaded radial slide, and the push-rod, which is lifted out of the radial recess at a determined torque, displaces the radial slide, an improvement comprising that said radial slide is guided radially in the driver and is always connected with the driver so as to be fixed with respect to rotation relative thereto;

coupling faces are provided between the radial slide and one of a cylinder core and a core pin forming an extension of said core, stopping surfaces are provided between the radial slide and the housing, said radial slide engages with either said coupling faces of the cylinder core or with the stopping surfaces of the housing; and said radial spring loading between the driver and the radial slide presses the push-rod in the direction of the rotational axis of the cylinder core and holds the overload catch in the effective position.

2. The device according to claim 1, wherein, in the overload catch which fixes the cylinder in the housing when the cylinder core is in neutral position or is rotated via the key, but sets the cylinder guide in a free-running state in the event of forcible rotation, the radial opening penetrates a wall of the housing and the radial recess for the inner radial end of the push-rod is incorporated in one of an outer surface of the cylinder guide and a guide bush forming an axial continuation thereof and faces toward an inner surface of the housing, while the spring-loaded stop face of the radial slide is located at a cylindrical outer surface of the housing.

3. The device according to claim 2, wherein, in the overload catch, the spring loaded radial slide tends to move the coupling faces into their coupling position and the stopping surfaces into their release position.

4. The device according to claim 1, wherein, in the overload catch which locks the cylinder core in a neutral position and is locked with the cylinder guide in the event of a forcible rotation but releases the cylinder guide during key rotation, the radial opening penetrates the wall of the cylinder guide and the radial recess for the inner radial end of the push-rod is incorporated in the circumferential surface of the cylinder core or in a core pin forming an axial continuation thereof and faces toward the inner surface of the cylinder guide, while the spring-loaded stop face of the radial slide is located at the outer surface of the cylinder guide, and wherein a catch recess which lies opposite the radial recess in the neutral position of the cylinder core is incorporated in the inner surface of the housing, the outer radial end of the push-rod moves into the catch recess in a free-running position of the overload catch generated by key rotation and accordingly fixes the cylinder guide in the housing.

5. The device according to claim 4, wherein, in the overload catch, the spring loaded radial slide tends to move the coupling faces into their uncoupled position and the stopping surfaces into their locking position.

6. The device according to claim 1, wherein the coupling faces are formed by a radial projection which is located at the radial slide and by a radial depression which is incorporated in one of the cylinder core and the core pin forming the extension thereof.

7. The device according to claim 6, wherein the two cooperating coupling faces are produced by two lateral flanks at a projection and by a two stop ends of a depression.

8. The device according to claim 7, wherein, in a coupling position of the overload catch, a free gap is located between one flank of one projection and the stop end of the depression associated therewith, said free gap being at least equal to the rotational path of the cylinder core when the inner radial end of the push-rod is lifted out of the radial recess.

9. The device according to claim 1, wherein the push-rod is a roller.

10. The device according to claim 1, wherein a radially springing catch projection projects through a wall bore hole of the housing at an inner surface of the housing and a neutral position of the cylinder guide in the housing is determined by engagement of the catch projection and a catch depression which is incorporated in an outer surface of the cylinder guide.

* * * * *